United States Patent [19]

Watanabe et al.

[11] Patent Number: 4,870,461

[45] Date of Patent: Sep. 26, 1989

[54] DEVELOPING DEVICE AND DEVELOPER CARRYING MEMBER USABLE THEREWITH

[75] Inventors: Tsuyoshi Watanabe; Takao Honda, both of Kawasaki, Japan

[73] Assignee: Canon Kabushiki Kaisha, Tokyo, Japan

[21] Appl. No.: 228,050

[22] Filed: Aug. 4, 1988

[30] Foreign Application Priority Data

Aug. 5, 1987 [JP] Japan ..... 62-196570

[51] Int. Cl.[4] ..... G03G 15/08

[52] U.S. Cl. ..... 355/251; 355/253; 355/265

[58] Field of Search ..... 355/251, 253, 261, 265; 118/657, 647, 651; 427/657; 430/120, 102, 125, 122

[56] References Cited

U.S. PATENT DOCUMENTS

| | | | |
|---|---|---|---|
| 3,863,603 | 2/1975 | Buckley et al. | 355/251 X |
| 3,879,737 | 4/1975 | Lunde | 355/251 X |
| 4,034,709 | 7/1977 | Fraser et al. | 355/251 X |
| 4,192,604 | 3/1980 | Koyama | 355/251 |
| 4,368,971 | 1/1983 | Watanabe et al. | 355/253 |
| 4,377,332 | 3/1983 | Tamura | 355/251 X |
| 4,383,497 | 5/1983 | Tajima | 118/651 |
| 4,444,864 | 4/1984 | Takahashi | 430/120 |
| 4,559,899 | 12/1985 | Kan et al. | 118/657 |

*Primary Examiner*—A. C. Prescott

*Attorney, Agent, or Firm*—Fitzpatrick, Cella, Harper & Scinto

[57] ABSTRACT

A developing apparatus for developing a latent image includes a device for supplying developer powder; a developer carrying member for carrying the developer powder supplied from the supplying device to a developing zone where a latent image bearing member is passed; wherein a surface of the developer carrying member for carrying the developer powder is blast-treated by a mixture of regular particles and irregular particles.

14 Claims, 2 Drawing Sheets

DEVELOPING DEVICE AND DEVELOPER CARRYING MEMBER USABLE THEREWITH

FIELD OF THE INVENTION AND RELATED ART

The present invention relates to a developing device and a developer carrying member usable therewith for an electrophotographic copying apparatus such as a copying machine, a laser beam printer or an LED printer.

U.S. Pat. Nos. 4,377,332, 4,380,966 and 4,579,082 (Japanese Laid-Open Patent Application No. 116372/1982) disclose a developing apparatus using a developer carrying member which will hereinafter be called "sleeve", which has been blasted with regular or irregular particles.

The sleeve blasted by the irregular particles is good in that it triboelectrically charge the developer to an appropriate extent, and in that the conveying property thereof is stabilized.

SUMMARY OF THE INVENTION

However, when continuous copy operation was carried out, using a stainless steel (SUS 316) sleeve having a surface roughened by being sand blasted with irregular particles (particles substantially each of which has plural sharp edges and apexes) having a particle size of #400 and using toner particles having small diameters which recently began to be used for improving image quality, the following was found:

(1) When the continuous operation reached 5000 copies, the image density decreased from 1.3 to 1.0;

(2) When a solid black was copied after the above decrease of image density, the copied image involved a very low image density portion (as if a part of the image was void) corresponding to the rotational period of the sleeve; and (3) The toner was removed from the sleeve surface after the above paragraph (2), and further, the sleeve surface was cleaned with solvent. When the copy operation was effected thereafter, the image density recovered.

The amount of triboelectric charge of the toner after the above paragraph (1) was measured and found to be one half the amount of charge at the start of the copy operation. It is considered that the decrease of the image density is attributable to the decrease of the charge amount of the toner.

The same investigations were made to the toner after the above paragraph (2), the void was found to be caused by decrease of the charge amount of the toner. However, the recovery stated in the above paragraph (3) indicates that the charge amount decrease is not attributable to the toner deterioration, but it is attributable to the sleeve. Therefore, the sleeve surface was observed by an electron microscope or the like, and it was found that the fine concave portions of the sleeve surface were impregnated with something, which was found as a result of an analysis to be a resin binder in the content of the toner. Therefore, it is considered that the toner is not sufficiently charged because the friction occurs frequently between the resin materials, i.e., the impregnated binder resin and the resin of the toner. Particularly at a deep part of the concave portion, the resin was strongly attached, and this is further enhanced by the sharp concave and convex portions resulting from the blasting by irregular particles.

Since it was considered that the sharp concave and convex configurations resulted in that the resin stuck on the sleeve surface, it was thought that the above problems would be solved if the surface was blasted with regular particles (particles substantially each of which has a generally round configuration like spherical, edge-like or flat spherical configuration substantially without sharp edge or apex) to provide a roughened surface with smooth concave and convex portions. When continuous copying operation was carried out, using a sleeve sandblasted with regular particles having a particle size of #400, the results were generally satisfactory, but other problems arose under specific conditions, as follows:

(4) When a whitish original which consumed very small amount of toner was continuously copied to provide 2000–5000 copies, the image density gradually decreased;

(5) With the above developing device, a solid black image was copied continuously, the image density gradually recovered; and (6) When the copy operation was performed under a low humidity conditions, the image density quickly decreased, and the developer was non-uniformly applied on the sleeve surface at some portions.

The surface of the sleeve was observed after the above paragraph (4), and it was found that the toner particle layer was formed thereon. However, the amount of electric charge thereof was found to be quite higher than the charge amount of the applied toner layer at the time of the copy operation start. The particle size of the toner deposited on the sleeve was measured, and it was found that major part of the toner had particle sizes of 1–5 microns. The diameters are clearly smaller than those of the toner particles contained in the developer container as a major part (7–12 microns).

Further considerations and investigations are made with respect to the above paragraphs (4)–(6). The toner is electrically charged by friction with the roughened surface of the sleeve, and electric charge having a polarity opposite to that of the toner is induced on the sleeve surface, by which the mirror force therebetween is effective to attract the toner on the sleeve surface. In this occasion, the amount of charge of the fine toner particles (1–5 microns) is relatively larger than that of most of the toner particles (7–12 microns), resulting in that the fine toner is applied on the sleeve surface as a thin coating. This thin layer of the fine toner obstructs the contact of the toner particles contributable to the development with the sleeve surface, and therefore, the toner particles having the particle size most contributable to the developing operation are not sufficiently charged, with the result that the image density decreases. Under a low humidity condition, the amount of charge of the fine toner particles is further increased, so that the toner conveying power for the toner on the sleeve is decreased, with the result that the application of the toner thereon becomes non-uniform.

It is considered that since the smooth fine concave portions are provided on the sleeve surface by the blasting with the regular particles, the contact area between the toner and the sleeve surface is larger than that between the toner and the roughened surface having sharp concave and convex portions provided by the blasting with irregular particles, so that the amount of electric charge becomes large. This introduces excessive triboelectric charge to the fine toner particles, which results in the above-described problems. A proper amount of electric charge is desired particularly when a vibratory electric field is formed in the developing zone to repeat deposition and release of the toner particles to an electrostatic latent image bearing member, by which an amount of toner particles corresponding to the potential of the latent image is left on the latent image bearing member.

Accordingly, it is a principal object of the present invention to provide a developing apparatus and a developer carrying member (sleeve) usable therewith, which is substantially free from the problems arising when the sleeve is treated by blasting with irregular particles and the problems arising when the sleeve is treated by blasting with regular particles.

It is another object of the present invention to provide a developing apparatus and a developer carrying sleeve usable therewith by which decrease of charge amount of the developer can be prevented.

It is a further object of the present invention to provide a developing apparatus and a developer carrying sleeve, by which decrease of the charge amount of the developer can be prevented, and the developer conveying power is stabilized.

It is a yet further object of the present invention to provide a developing apparatus and a developer carrying sleeve usable therewith which can continuously provide good developed images.

It is a yet further object of the present invention to provide a developing apparatus and a developer carrying sleeve usable therewith by which good developed images can be provided under a low humidity condition.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
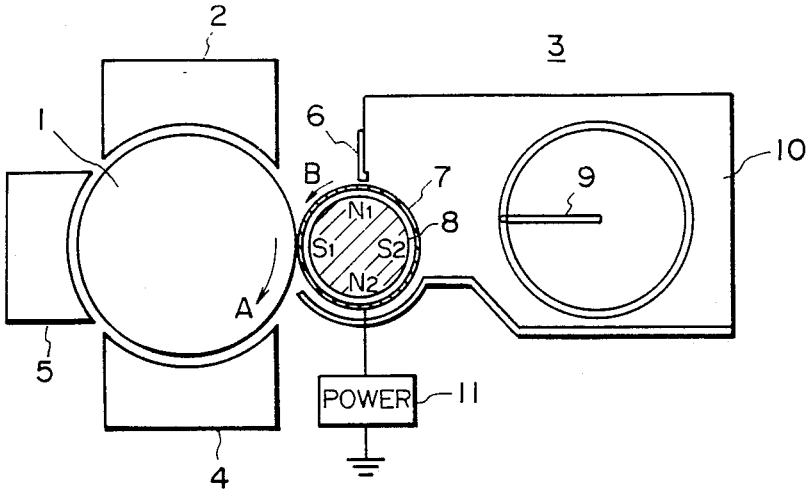
FIG. 1 is a somewhat schematic drawing illustrating a developing apparatus and a developer carrying sleeve according to an embodiment of the present invention.

Referring to FIG. 1, there is shown a copying machine which is an exemplary image forming apparatus usable with a developing device and a developer carrying sleeve according to an embodiment of the present invention.

The copying machine includes a latent image bearing member 1 which is usually an electrophotographic photosensitive member, which will hereinafter be called "photosensitive drum", a known electrostatic latent image forming station, a developing device 3 according to the present invention for visualizing the latent image, a transfer and separation station 4 where the visualized toner image is transferred from the photosensitive drum 1 to a transfer material and for separating the transfer material from the photosensitive drum 1, and a known cleaning station for removing the toner remaining on the photosensitive drum 1. In this embodiment, magnetic toner particles are used, each of which contains magnetic particles and binder resin.

On the photosensitive drum 1, an electrostatic latent image is formed by the latent image forming station 2. By the rotation of the photosensitive drum 1 in the direction A, the latent image reaches the developing device 3.

The developing device 3 comprises a developing device container 10 for containing magnetic toner which is a one component developer in this embodiment, stirring means 9 for feeding the toner from a hopper of the container 10 to a neighborhood of the sleeve and for enhancing fluidability of the toner, a stationary magnet 8, and a sleeve 7 made of non-magnetic material and rotatable about the outside of the magnet 8 in the direction B. The sleeve 7 is effective to carry the toner particles thereon to a developing zone where the sleeve 7 is opposed to the photosensitive drum 1, and applies the toner to the drum 1.

A thickness of the toner layer formed on the sleeve 7 is regulated by a magnetic blade 6 as disclosed in U.S. Pat. No. 4,387,664, and which is opposed to a magnetic pole N1 of the magnet 8 with the sleeve 7 interposed therebetween. In the developing zone where the sleeve 7 and the drum 1 are opposed, the toner is erected at a magnetic brush by the developing pole S1, and the toner is transferred from the sleeve 7 to the drum 1 by the electric field formed between the latent image on the drum 1 and the sleeve 7 to develop the latent image. To make the toner transfer easier, the developing bias is applied to the sleeve 7 by a power source 11. To the sleeve 7, an alternating bias voltage is applied by the power source 11. By this, the toner moved from the sleeve 7 to the drum 1 is repeatedly deposited to and released from the photosensitive drum 1. When the drum surface departs the developing zone, the toner remains on the photosensitive drum, corresponding to the potential of the latent image. The alternating voltage is not limited to those wherein peaks appear alternately in positive and negative polarities, but includes a vibratory voltage which vibrates in a positive voltage side only, or in the negative voltage side only. In this embodiment, the alternating bias voltage is applied to the sleeve 7 to form a vibratory electric field in the developing zone. However, the present invention is applicable to a developing device wherein a DC bias voltage is applied to the sleeve 7. The toner image is transferred from the photosensitive drum 1 to the transfer material in the transfer and separation station 4, and then the transfer material is transported to an unshown image fixing station, where the toner image is fixed on the transfer material. On the other hand, the residual toner remaining on the drum 1 is removed by the cleaning station 5 so as to be prepared for the next latent image formation.

Examples of various dimensions are as follows: 850 Gausses on the sleeve surface of N1 pole of the magnet 8, 950 Gausses of S1 pole, 750 Gausses of N2 pole, 550 Gausses of S2 pole, 0.3 mm of minimum clearance between the sleeve 7 and the drum 1, and 0.25 mm of a clearance between the sleeve 7 and the blade 6. Therefore, in this example, a toner layer having a thickness smaller than the clearance between the sleeve 7 and the drum 1 is carried to the developing zone. The power source 11 provides an alternating voltage having a peak-to-peak voltage of 1300 V and a frequency of 1600 Hz superposed with a DC motor of −200 V. The photosensitive drum has a photosensitive layer of OPC (organic photoconductor), and the latent image formed thereon has a dark potential (at the darkest portion) of −650 V and a light portion potential (background area) of −150 V. The copy speed is 20 copies per minute for A4 size sheets. The diameter of the sleeve 7 is 20 mm, and is made of stainless steel (SUS 316). The surface thereof has been blast-treated. The material of the sleeve may be aluminum or titanium steel.

The blast treatment is effected with a mixture of irregular blast abrasive material or particles having a rough surface, made of $Al_2O_3$ and having a particle size of #400 and a regular blast abrasive (having a spherical and a flat-spherical configuration and having a smooth surface, preferably) made of glass beads and having a particle size of #400, at a ratio of 1:1. The mixture is blasted at a sleeve rotating at 12 rpm from a nozzle having a diameter of 7 mm and distant from the sleeve by 100 mm, with air of pressure of 3 kg/cm$^2$ the nozzle is moved in parallel with the length of the sleeve at a speed of 30 cm per 1 min or 2 min. After this sandblast treatment, the sleeve is cleaned and dried.

Using the developing device having the sleeve treated in the manner described above, a developing operation was carried out. The results were that the toner coating on the sleeve was maintained uniform even with continued copying operation and that a high image density was maintained therewith. After the continued copying operation, a solid black image was copied, but no void part was produced. Further, white image was copied on several thousands sheets, but the image density did not decrease.

In this embodiment, the ratio of contents of the regular and irregular particles is 1:1. This is advantageous because the finely roughened surface region provided by the irregular particles and the relatively smooth concave surface portions provided by the regular particles are uniformly distributed on the surface of the developer carrying member. However, the present invention is not limited to this ratio.

The surface of the sleeve after the blast treatment, is observed by an electron microscope, and is found to have the following structure.

Figure 4:
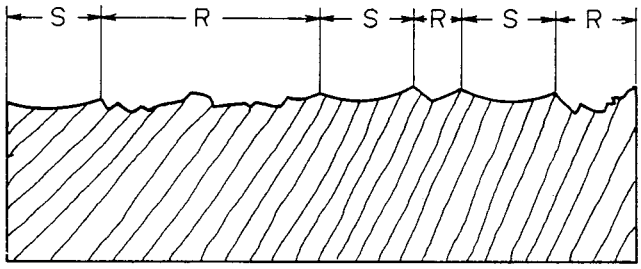
FIG. 4 is an enlarged longitudinal sectional view of a part of a sleeve surface portion according to an embodiment of the present invention.

As shown in FIG. 4, finely rough region R provided by the irregular particles and relatively smooth concave portions (dimples) S provided by the regular particles are mixedly distributed. The roughened region R involves a large number of sharp and fine projections, but the relatively smooth concave region S does not involve many sharp projections. All of the relatively smooth concave regions do not have the same surface property, but various concave regions having different surface roughnesses such as 0 S, 0.2 S, 0.8 S and 1.6 S are mixedly distributed. In other words, the sleeve surface has mixedly distributed fine regions having different surface roughness.

Figure 2:
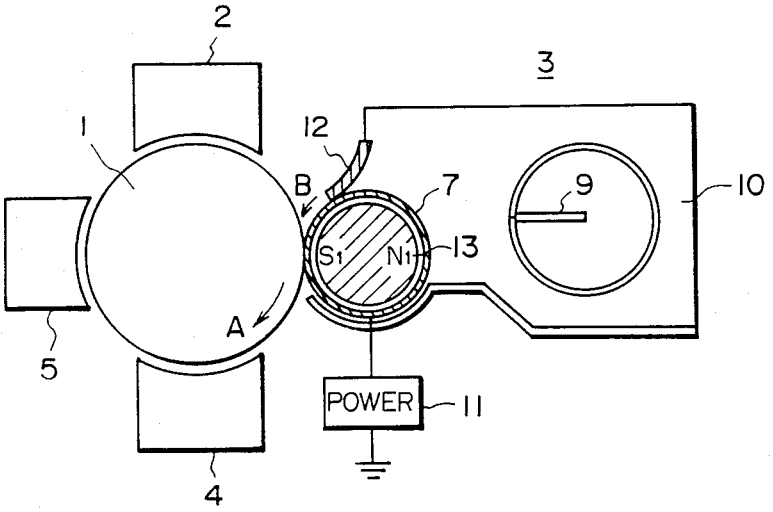
FIG. 2 is a somewhat schematic drawing illustrating a developing apparatus and a developer carrying sleeve according to another embodiment of the present invention.

Referring to FIG. 2, a second embodiment will be described. The same reference numerals are assigned as in FIG. 1 embodiment to the elements having corresponding functions, and the detailed explanation is omitted for the sake of simplicity.

The important feature of this embodiment is an elastic member 12 such as a rubber blade is contacted to the sleeve 7 as for the toner layer thickness regulating member, rather than utilizing a magnetic field. By using the blade 12 to regulate the toner layer, the necessity of the regulating magnetic pole is eliminated. Therefore, the number of magnetic poles can be reduced, and the diameter of the magnet roller can be reduced, and in addition, the cost is decreased. In FIG. 2, the magnet roller 13 has only two magnetic poles. The strength of the magnetic field on the sleeve provided by those magnetic poles is 600 Gausses by the pole S1 and 500 Gausses by the pole N1. The other dimensions such as the clearance between the sleeve 7 and the drum 1 and the power source 11 are the same as in the first embodiment.

The blade 12 is pressed to the sleeve 7 under a pressure of 2–10 g/cm along the length of the sleeve, and is made of urethane rubber having a thickness of 0.8–1 mm, neoprene rubber or nitrile rubber or another rubber material or plastic resin sheet such as PET sheet having a thickness of 100 microns, polyamide sheet or polyimide sheet.

This embodiment, the urethane rubber is used.

The sleeve 7 is made of stainless steel SUS 316, and the surface thereof is blast-treated. The blasting material is a mixture of irregular blast abrasive of silicon carbide and having a particle size of #600 and regular blasting material of glass beads having a particle size of #400. Since the blade 12 is in contact with the sleeve 7 in this embodiment, the sleeve surface is preferably smoother than in the first embodiment. To achieve this, the content of the irregular blasting abrasive is reduced such that the ratio of the irregular blasting abrasive and the regular blasting abrasive is 2:8 or 3:7. The conditions under which the abrasive is applied to the sleeve are the same as with the first embodiment.

The image forming operation was performed with the developing device 3 using the sleeve 7 sandblasted in the manner described above. Even after continuous copying operation, the toner was not non-uniformly applied on the sleeve 7; the toner was not fused on the sleeve; a defective image such as having black stripes or the like was not produced; and a high density image was provided stably. The surface of the sleeve also has finely roughened regions having many sharp projections provided by the irregular particles and relatively smooth concave portions not having many sharp projections provided by the regular particles, which regions are mixed on the surface. Since, however, the content of the regular particles is large in the mixed blasting material, the number of the relatively smooth concave portions is larger than in the first embodiment.

Figure 3:
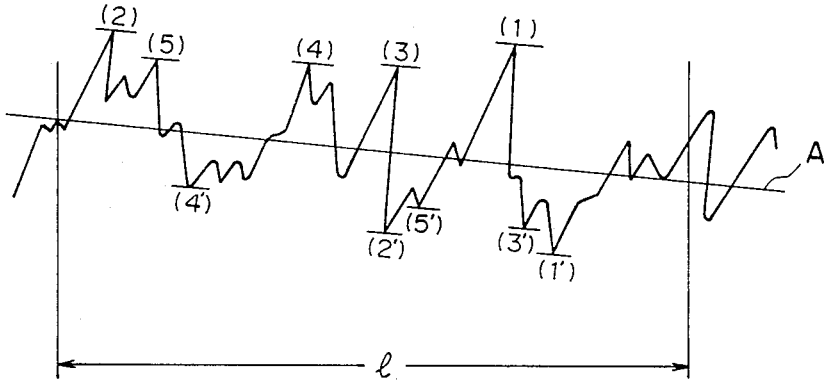
FIG. 3 is a graph illustrating a method of surface roughness.

The measurement of the roughness referred to in this specification was obtained by a fine surface roughness meter available from Tailor Bobson Co. or from Kosaka Laboratory. FIG. 3 shows the method of measurement, wherein the average roughness Rz=1.5 micron, and pitch is 19 microns under the following conditions.

The surface roughness is determined by JIS ten-point average roughness (Rz) "JIS B0601". Namely, the surace roughness is represented by a distance (micrometer, microns) between a straight line which is parallel to the average line in a portion of the profile curve picked up by a reference length 1 and passes through the third peak counted from the maximum peak and a straight line which passes through the third valley counted from the maximum depth. The reference length L is 0.25 mm. By counting the number of peaks higher 0.1 micron or more than two adjacent valleys along the reference length of 0.25 mm, pitch P is determined from the following formula: P=250 microns/the number of the above counted peaks.

Then, the description will be made as to why the blasting treatment using a mixture of the irregular blasting abrasive and the regular blasting abrasive.

In the first embodiment, an average amount of toner was measured after 2000 copies were continuously produced, and it was reduced only by 8–10% of the amount of triboelectric charge when the operation started. The amount of charge thereafter hardly changed. It is, therefore, understood that the surface of the sleeve is not coated by the fine toner particles so that the amount of triboelectric charge of the toner provided by the contact with the sleeve is always maintained constant. It is confirmed by observation of the sleeve surface that a small amount of resin or the like is deposited thereon. When the roughness of the sleeve surface is measured, Rz was 1.5 micron, and the pitch was 30–35 microns. Since Rz was equal to 1.5 micron, and the pitch was 15–20 microns when the sleeve was blast-treated only by irregular blasting abrasive, it is understood that the pitch became longer, and the number of projections is reduced in this embodiment. The observation by an electron microscope has revealed that the concave portions formed by the regular particles have smooth configurations so that it is difficult for the resin or the like to be deposited. Because it is difficult for the binder resin of the toner to be deposited to the concave portions, and because proper projections formed by the irregular particles are present together with such concave portions, the amount of triboelectric charge of the toner is not increased extremely. The reason why the number of sharp projections is reduced but is still maintained properly, is that the process of the regular blasting abrasive collapses the roughened surface provided by the irregular blasting abrasive to make the concave portions smoother and depressing the convex portions, and then the process of the irregular blasting abrasive again collapsing them, are mixedly repeated. Thus, because the irregular blasting abrasive grain and the regular blasting abrasive grain are mixed, an appropriate number of the sharp projections (most of them are provided by the irregular particles) and a proper number of concave portions (most of them are provided by the regular particles) are formed so that a proper image is always maintained.

For the purpose of confirmation, the sleeve was first blast-treated by the irregular blasting abrasive, and thereafter, it was blast-treated by the regular blasting abrasive. The results were that the pitch became longer, and the concave portions became smoother, but Rz=0.5 micron, and the sharp projections were collapsed by the regular blasting abrasive and became smaller. In addition, the treatment with the regular blasting abrasive was first performed, and then the treatment with the irregular blasting abrasive were performed, the smooth concave portions were roughened to such an extent that it was at last the same as the treatment with the irregular blasting abrasive only.

The average amount of charge of the toner in the second embodiment was measured after 200 copies were continuously produced, it was reduced only by 6–8% of the amount when the continuous operation started. The amount of charge thereafter hardly changed. It is understood from this that the sleeve surface is not coated with fine toner particles, and the amount of the triboelectric charge of the toner provided by the friction with the sleeve is always maintained constant. Also, the amount of the resin deposited on the sleeve surface is very small. The roughness of the sleeve was such that Rz was equal to 1.2 micron, and the pitch was 35–50 microns.

Preferable conditions in the present invention will be described.

The developer may be a one component dry developer or a two component dry developer containing carrier and toner particles. The blasting material is preferably a uniform mixture of the regular particles and irregular particles.

The number A of regular particles and the number B of irregular particles satisfy that A/B is not less than 1/20 and not more than 9/1, since then the above effects are provided without influence by the particle sizes thereof. Further, when A/B is not less than $\frac{1}{2}$ and not more than 4/1, the ratio of the finely roughened regions and relatively smooth concave regions is stabilized, and in addition, it is assured that unit regions having different surface roughnesses are uniformly distributed on the surface.

The particle size of the regular particles is preferably not less than #40 not more than #800 (R6001), and that of the irregular particles is not less than #50 and not more than #1000 (JIS R6001).

It has been found that the average particle size C of the regular particles and the average particle size D of the irregular particles preferably satisfy that C/D is not less than 1/10 and not more than 10/1, empirically. Further preferably, if C/D is not less than $\frac{1}{2}$ and not more than 4/1, relatively smooth concave portions by the regular particles and relatively fine concave and convex portions by the irregular particles are formed, and in addition, unit areas having different surface conditions are uniformly distributed assuredly.

In order to further stabilize the advantageous effects, it is considered that the dimension, in the direction of conveying the developer, of the concave portions provided by the regular particles is not less than 5 microns and not more than 100 microns, and the depth is larger than 0 micron and not more than 10 microns, and that the roughened portions provided by the irregular particles have a pitch of not less than 2 microns and not more than 50 microns and an average roughness Rz of not less than 0.1 micron and not more than 8.0 microns. This is an estimation from the measurements of the surface blast-treated only by regular particles and the surface blast-treated only by the irregular particles, because it is difficult in the above-described measurement that the concave portions provided by the regular particles and the roughened surface provided by the irregular particles are discriminated.

The irregular particles may be made of silicon carbide, alumina, iron trioxide and titanium dioxide. The regular particles may be made of glass beads, steel, ferrite or flat ferrite particles. However, materials thereof are not limited to those.

The developer carrying member has been described as a sleeve, but it may not be in the form of a cylinder, but may be columnar or form of a belt, and may be a magnet roller itself.

In the foregoing embodiment, a developer layer having a thickness smaller than the clearance between the sleeve and the drum is carried to the developing zone, but the present invention is applicable to a developing device wherein a developer layer having a thickness equal to or larger than the clearance between the sleeve and the drum is carried to the developing zone.

The present invention is most suitably applicable with toner particles having an average diameter of 3–10 microns, but the present invention is not limited to this case.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image, comprising:

means for supplying developer powder; and a developer carrying member for carrying the developer powder supplied from said supplying means to a developing zone where a latent image bearing member is passed;

wherein a surface of said developer carrying member for carrying the developer powder is blast-treated by a mixture of regular particles and irregular particles.

2. An apparatus according to claim 1, further comprising means for forming a vibratory electric field in the developing zone.

3. An apparatus according to claim 2, wherein said vibratory electric field forming means applies an alternating voltage to said developer carrying member.

4. An apparatus according to claim 1, 2 or 3, further comprising means for regulating a thickness of developer layer carried to the developing zone, said regulating means including an elastic member in contact with said developer carrying member.

5. An apparatus according to claim 1, 2 or 3, wherein said developer carrying member is a non-magnetic rotatable member, and carries a developer containing magnetic particles, said apparatus further comprising a stationary magnet disposed in said rotatable developer carrying member, and a magnetic member disposed opposed to said developer carrying member with a clearance, wherein said magnetic member is opposed to a magnetic pole of said magnet with a part of said developer carrying member interposed therebetween, said magnetic member being effective to cooperate with the magnetic pole to regulate the thickness of a developer layer.

6. An apparatus according to claim 4, wherein said elastic member provides the thickness of the developer layer which is smaller than the clearance between the latent image bearing member and said developer carrying member.

7. An apparatus according to claim 5, wherein said magnetic member provides the thickness of the developer layer which is smaller than the clearance between the latent image bearing member and said developer carrying member.

8. An apparatus according to claim 1, 2 or 3, wherein the developer carrying surface of said developer carrying member is blast-treated by the mixture of regular particles made of a material selected from glass beads, steel particles, ferrite particles and flat ferrite particles, and the irregular particles are made of a material selected from silicon carbide particles, alumina particles, silicon dioxide particles, trioxide ion particles and titanium dioxide particles.

9. An apparatus according to claim 1, 2 or 3, wherein a number A of the regular particles in the mixture and a number B of the irregular particles therein satisfy A/B is not less than 1/20 and not more than 9/1.

10. An apparatus according to claim 9, wherein an average particle size C of the regular particles in the mixture and an average particle size D of the irregular particles in the mixture satisfy C/D is not less than 1/10 and not more than 10/1.

11. A developer carrying member for carrying developer powder to a developing zone where an electrostatic latent image is formed, the improvement comprising a developer carrying surface of said developer carrying surface of said developer carrying member which is blast-treated with a mixture of regular particles and irregular particles.

12. An apparatus according to claim 11, wherein the developer carrying surface of said developer carrying member is blast-treated by the mixture of regular particles made of a material selected from glass beads, steel particles, ferrite particles and flat ferrite particles, and the irregular particles are made of a material selected from silicon carbide particles, alumina particles, silicon dioxide particles, trioxide ion particles and titanium dioxide particles.

13. An apparatus according to claim 11 or 12, wherein a number A of the regular particles in the mixture and a number B of the irregular particles therein satisfy A/B is not less than 1/20 and not more than 9/1.

14. An apparatus according to claim 13, wherein an average particle size C of the regular particles in the mixture and an average particle size D of the irregular particles in the mixture satisfy C/D is not less than 1/10 and not more than 10/1.

* * * * *

UNITED STATES PATENT AND TRADEMARK OFFICE

CERTIFICATE OF CORRECTION

PATENT NO. : 4,870,461

DATED : September 26, 1989

INVENTOR(S) : TSUYOSHI WATANABE, ET AL.

It is certified that error appears in the above-identified patent and that said Letters Patent is hereby corrected as shown below:

COLUMN 1

Line 20, "charge" should read --charges--.

COLUMN 6

Line 20, "This" should read --In this--.
Line 58, "su-" should read --surface--.
Line 59, "race" should be deleted.

COLUMN 7

Line 3, "why" should be deleted.
Line 56, "were" should read --was--.

COLUMN 8

Line 23, "#40 not" should read --#40 and not--.
Line 59, "not" should be deleted.
Line 60, "but" should read --or--.

UNITED STATES PATENT AND TRADEMARK OFFICE

CERTIFICATE OF CORRECTION

PATENT NO. : 4,870,461

DATED : September 26, 1989

INVENTOR(S) : TSUYOSHI WATANABE, ET AL.

It is certified that error appears in the above-identified patent and that said Letters Patent is hereby corrected as shown below:

COLUMN 10

Line 15, "trioxide ion particles" should read --iron trioxide particles--.

Line 40, "trioxide ion particles" should read --iron trioxide particles--.

Signed and Sealed this

First Day of October, 1991

*Attest:*

*Attesting Officer*

HARRY F. MANBECK, JR.

*Commissioner of Patents and Trademarks*